United States Patent [19]

Hewlett

[11] Patent Number: 4,989,418

[45] Date of Patent: Feb. 5, 1991

[54] COOLING WRAP

[76] Inventor: Kenneth M. Hewlett, 702 17½St. SE., Rochester, Minn. 55904

[21] Appl. No.: 550,399

[22] Filed: Jul. 10, 1990

[51] Int. Cl.[5] ..... F25D 3/08

[52] U.S. Cl. ..... 62/457.4; 62/372; 62/530

[58] Field of Search ..... 62/372, 457.4, 530

[56] References Cited

U.S. PATENT DOCUMENTS

| | | | |
|---|---|---|---|
| 4,344,303 | 8/1982 | Kelly, Jr. | 62/530 |
| 4,399,668 | 8/1983 | Williamson | 62/457.4 |
| 4,534,354 | 8/1985 | Bonner, Jr. et al. | 62/530 X |
| 4,592,358 | 6/1986 | Westplate | 62/530 X |
| 4,676,247 | 6/1987 | Van Cleve | 62/530 X |
| 4,831,842 | 5/1989 | Kelley et al. | 62/530 X |
| 4,886,063 | 12/1989 | Crews | 62/372 X |

*Primary Examiner*—Lloyd L. King

*Attorney, Agent, or Firm*—Haugen and Nikolai

[57] ABSTRACT

An improved wrap including a pouch formed by opposed inner and outer faces. A first blanket made of a heat absorbing material is integrally attached to a second blanket made of a heat insulating material. The joined first and second blankets are permanently insertable into the pouch. Fastening means are attached to opposite ends of the pouch so that the ends of the pouch may be secured together after the pouch has been wrapped around a fluid container. The fastening means also serve to hold the integrally connected first and second blankets in position within the pouch.

14 Claims, 2 Drawing Sheets

COOLING WRAP

TECHNICAL FIELD

The present invention relates to a flexible wrap used around a fluid container, such as a beverage can, for keeping the fluid cool. More particularly, this invention relates to a flexible and removable multi-layer wrap having an integral heat absorbing layer and a heat insulating layer.

BACKGROUND OF THE INVENTION

Flexible wraps are used around individual beverage containers, such as cans or cups, for keeping the beverage cool. These wraps typically employ some type of heat absorbing material which extracts heat from the beverage. This material is usually precooled to enable absorption of heat. In addition, the heat absorbing material is often insulated by a layer of material with low thermal conductivity. One such prior device, known as the Ice Wrap, is manufactured by Cordy Corporation of Minnesota. This is described in U.S. patent application Ser. No. 07/546,534 to Ken Hewlett, et al., inventor of the present invention filed on June 29, 1990 and entitled COOLING WRAP AND METHOD OF MANUFACTURING. The Cordy Corporation device does not feature an integral heat absorbing and insulating blanket but requires the user to insert a cold pack into a pocket prior to each use. Since the wrap does not require cooling, the wrap and cold pack are usually stored separately and the potential for misplacing one or the other is present.

U.S. Pat. No. 4,399,668 to Williamson discloses another example of a beverage cooler of this general type. In one embodiment, the cooler includes a pocket for receiving a coolant layer that has been pre-cooled in a refrigeration device. An insulation layer is located adjacent the coolant layer. Fasteners on the ends of the device are used to secure the ends together after the device has been wrapped around a beverage container. The fasteners may include Velcro strips.

One problem in manufacturing these prior wraps, including that shown in the Williamson patent, is the difficulty in aligning the multiple layers thereof and securing them together. For example, the insulating layer comprises a relatively thick blanket of insulative fabric. This blanket has to be faced with the material forming the pocket for the coolant layer. Then, this assemblage has to be put into a sewing machine and sewed together. This can be relatively difficult to do, given the thickness of the materials and the need to keep them aligned while the assemblage is turned in the sewing machine during the sewing operation.

Prior art wraps have also suffered from difficulty of manufacture and from the tendency of the heat absorbing material to move to undesirable locations. Upon applying prior art wraps, the localized force generated tends to reposition the elements of the wrap such that their performance is substantially degraded.

It is one object of this invention to provide an improved flexible multi-layer wrap for keeping a fluid container cool including an integral heat absorbing and heat insulating layer permanently contained within the wrap.

It is another object of the present invention to provide a heat absorbing material integrally fastened to a heat insulating material.

It is a further object of the invention to provide a flexible wrap after substantial cooling of the wrap has occurred.

Accordingly, an improved wrap of this invention comprises providing a pouch formed by opposed inner and outer faces. A first blanket made of a heat absorbing material is further provided to be integrally attached to a second blanket made of a heat insulating material wherein the joined first and second blankets are permanently insertable into the pouch. Fastening means are attached to opposite ends of the pouch so that the ends of the pouch may be secured together after the pouch has been wrapped around a fluid container. The fastening means also serve to hold the integrally connected first and second blankets in position within the pouch.

BRIEF DESCRIPTION OF THE DRAWINGS

To illustrate this invention preferred embodiment of this invention will be described hereinafter with reference to the accompanying figures. The preferred embodiment concerns a cooling wrap for beverage containers.

DESCRIPTION OF THE PREFERRED EMBODIMENT

Figure 3:
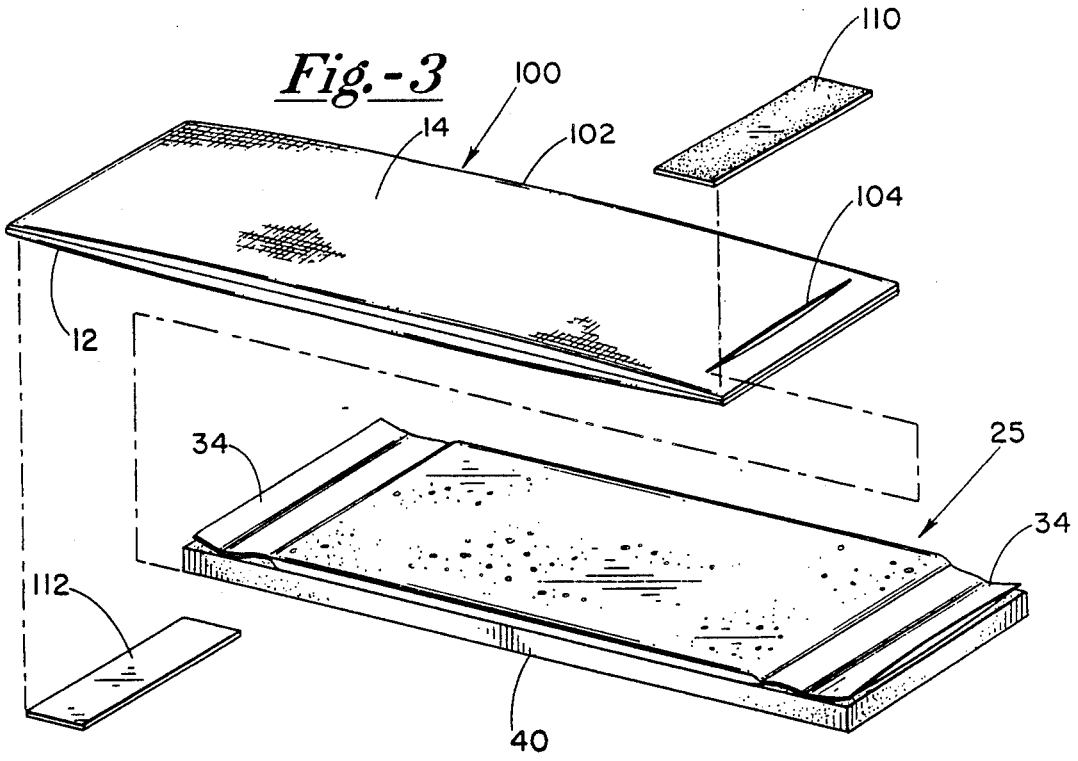
FIG. 3 is a perspective view of another of the steps of the manufacture of an improved multi-layer wrap according to this invention, particularly illustrating the step of attaching a strip of fastening material across the slip in the outer pocket to enclose the integral insulating and heat absorbing blanket in the outer pocket of a pouch.

A wrap according to the present invention is illustrated generally as 10 in the drawings. As is best shown in FIG. 3, wrap 10 includes a pouch 100 having a rectangular outer layer 12 and a rectangular inner layer 14. The outer layer 12 of the pouch 100 is generally the same size as inner layer 14 abutted against one face of outer layer 12. All of the layers 12, 14 are made of a suitable durable, long-lasting fabric, e.g., rayon, nylon, etc.

Still referring to FIG. 3, layers 12, 14 are secured together in a first step to form pre-formed pouch 100. In this regard, the layers 12, 14 are superimposed over one another with the peripheral edges joined together by stitching 102. In one embodiment of the invention, layers 12 and 14 are sewn together with their exterior surfaces "face-to-face" so as to form an inside-out pouch which is turned right side out when the integral heat absorbing blanket and insulating blanket is inserted.

Figure 1:
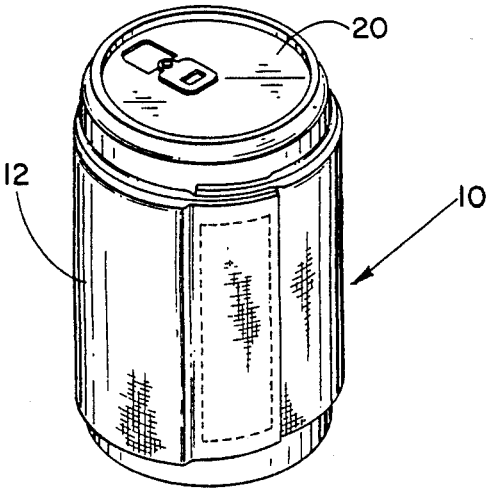
FIG. 1 is an isometric view of a beverage container with the object of the present invention wrapped around it.

It is important to note that the words "inner" and "outer" when applied to layers 12, 14 refer to the inner and outer sides of the wrap 10 when wrap 10 is placed around a beverage container 20 as shown in FIG. 1.

An entrance opening 104 is advantageously provided into the pouch 100 by transversely slitting the inner layer 14. Thus, pocket 100 has an open slit transverse end and comprises a longitudinally extending pocket for receiving an integral heat absorbing and insulating blanket 25 as described hereafter. Opening 104 should be somewhat shorter than the width of blanket 25 in order to facilitate holding the blanket in place during assembly.

Figure 2:
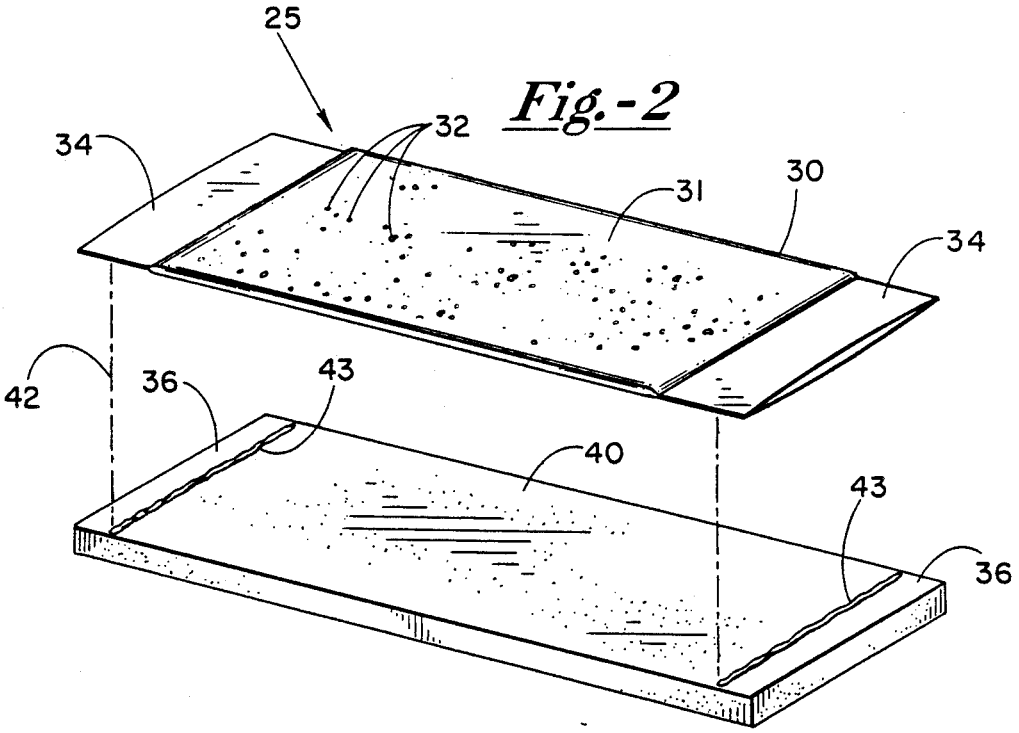
FIG. 2 is a perspective view of one of the steps of the manufacture of an improved multi-layer wrap according to this invention, particularly illustrating the step of attaching the insulating blanket to the heat absorbing blanket.

Referring now to FIG. 2, in manufacturing a wrap 10 according to this invention, the first step is to form or provide a pre-formed pouch assembly 100 as just described, i.e. having inner and outer layers 12, 14 as set forth above forming a pouch. Then, insulation and heat absorbing blanket 25, which is constructed as follows, is slipped into outer pouch 100 through slit 104. The heat absorbing and insulating blanket 25 is formed by joining a heat absorbing layer 30 to an insulating layer 40. The heat absorbing layer could be any flexible material consisting of a high heat capacity. The heat insulating layer could be any insulating material flexible enough to be non-destructively wrapped and suitably bent to be installed into the pouch 100 through slit 104. The two layers 30 and 40 are advantageously bound together with glue using a hot glue gun at glue lines 43. Alternatively, the layers may be thermally bonded at the edges 36. The heat absorbing and insulating blanket 25 is, therefore, mechanically stable and will tend to resist bunching and folding relative to the entire wrap assembly. The unit 25 will be conveniently referred to herein as "the blanket 25". The heat absorbing material may have any of numerous suitable forms. One preferred form is to use a material which does not freeze solid even when chilled. Thus, heat absorbing blanket 30 will be flexible even when it is chilled to allow wrap 10 to be wrapped around container 20. Note that the heat absorbing layer 30 may preferably be a plastic bag containing a non toxic, refreezable and reusable cold pack gel 32 of a type which is commercially available. Layer 30 preferably includes edges 34 and the gel is contained between the edges 34 in compartment 31. The edges 34 are of a suitable width and length so as to allow them to be sown through when the fastening means 110, 112 are attached without puncturing the gel compartment 31. The insulating layer 40 may advantageously be comprised of an open or closed cell ⅜" prime urethane foam cushion or similar materials.

Alternatively, it would be possible to use in blanket 30 a heat absorbing material which does freeze solid when chilled. In such a case, however, the covering for the heat absorbing blanket would be formed with a plurality of transverse compartments in which the heat absorbing material is contained. These compartments would be separated by transversely extending score lines. These score lines are necessary to allow wrap 10 to be bent around container 20.

Referring again to FIG. 3, blanket 25 is sized to fill approximately all of the interior space of pouch 100. In addition, blanket 25 is made of compressible materials to allow the blanket to be compressed as it is inserted into slip 104. Blanket 25 is then pushed into the pouch 100 until it clears slit 104, after which blanket 25 will expand to substantially fill pouch 100. The expansion of blanket 25, which occurs naturally after the constriction formed by slip 104 is passed, will conveniently keep blanket 25 retained in pocket 104 since it is now too big to fall back out of slip 104 once it re-expands inside of pouch 100.

In one embodiment of the invention, blanket 25 is folded in half lengthwise and held in place by a tooling mechanism having an angular shape suitable for holding the folded blanket 25 in place in an upright position. Pouch 100 is fabricated by sewing layers 12 and 14 "inside out". That is, with their decorative exterior faces abutting each other. The pouch 100 may then be rolled up similar to a sock and then drawn over the top of the tooling mechanism and blanket, covering both but now inverted so as to show the exterior faces. An operator can then pull the new inserted blanket out of the tooling mechanism. The blanket 25 will expand to fill the pouch, which now has its exterior surfaces showing, (i.e. which is "right side out").

Figure 4:
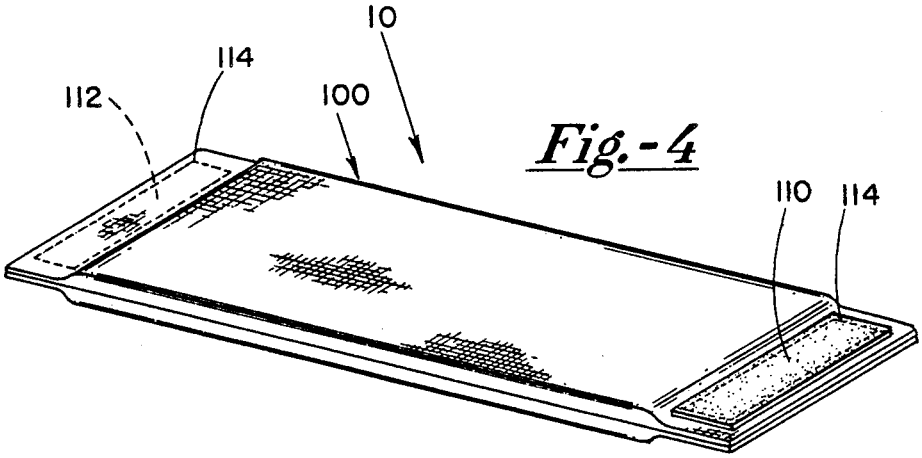
FIG. 4 is a perspective view of the wrap according to the present invention, showing the completed wrap assembly.

Now referring to FIGS. 3 and 4, after insulation blanket 25 is installed, the next step is to provide suitable fastening means on opposed ends of wrap 10 and on opposite faces thereof. Preferably, the fastening means comprises first and second strips 110 and 112 of Velcro material, i.e. a hook and pile fastener. Thus, first strip 110 comprises a strip of Velcro pile material and second strip 112 comprises a strip of Velcro hook material. Desirably, strips 110 and 112 are simply sewn in a transverse direction to the opposed faces of jacket assembly 100 as indicated by stitching 114. However, any other suitable fastening means or attachment methods could be used in place of Velcro strips 110 and 112 and stitching 114.

One of the fastening strips, i.e., Velcro pile strip 110 is sewn to outer layer 14, across slit 104. Thus, fastening strip 110 effectively closes the entrance opening to pouch 100 after blanket 25 is inserted therein for permanently retaining blanket 25 in pouch 100 during use over the normal life of wrap 10. The other fastening strip, i.e. Velcro hook strip 112 is sewn to the opposite end of pouch 100. It is important to note that the fastening strips also are sewn through edges 34 of blanket 25 so as to further locate blanket 25 within the pouch and hold it in place. Once the fastening means has been attached to jacket assembly 100 as just described, wrap 10 may be used.

Wrap 10, according to this invention, is easier to manufacture than prior art wraps of this type. It is much easier to sew the layers 12, 14 forming pouch assembly 100 together when blanket 25 is not sandwiched therein. Then, it is relatively easy to simply slip blanket 25 into pouch 100 formed to receive it. The use of one of the fastening strips 110 and 112 positioned on top of slit 104 is a convenient and inexpensive way of closing the entrance to pouch 100 and permanently uniting blanket 25 to pouch 100.

As can be appreciated, the invention is used by placing it in a cold area and letting heat escape from the wrap. The wrap is used by pressing the releasable hook and pile fastener strips 110 and 112 together.

After wrap 10 is installed, and beverage container 20 starts to absorb ambient heat from the environment, that heat is transferred into heat absorbing blanket 30, causing the blanket to gradually warm up and lose its stored coldness. In other words, the cold temperature stored in heat absorbing blanket 30 is traded off for any heat accumulating in container 20 tending to heat the beverage. The use of insulating blanket 40 helps slow down the rate at which heat is transferred into the environment. The net effect of the operation of wrap 10 is that the beverage in container 20 stays cooler than it would otherwise. This is a desirable advantage for keeping drinks cool longer.

This invention has been described herein in considerable detail in order to comply with the Patent Statutes and to provide those skilled in the art with the information needed to apply the novel principles and to construct and use such specialized components as are required. However, it is to be understood that the invention can be carried out by specifically different equipment and devices, and that various modifications, both as to the equipment details and operating procedures, can be accomplished without departing from the scope of the invention itself.

What is claimed is:

1. An improved flexible, multi-layer wrap for wrapping around a fluid container to reduce the rate of heating of the fluid, which comprises:

(a) a pouch assembly formed by opposed inner and outer layers thereof having an entrance opening therein;

(b) an integral heat absorbing and heat insulating blanket which when cooled has an inner side capable of absorbing heat from the fluid and an outer side capable of insulating one side of the blanket, wherein the integral heat absorbing and heat insulating blanket is inserted into the entrance opening of the pouch; and (c) first and second fastening means attached to opposite ends of the pouch assembly so that the ends of the pouch assembly may be secured together after the pouch assembly has been wrapped around the fluid container such that the inner side is adjacent to container, and wherein the fastening means are attached so as to secure the ends of the integral heat absorbing and heat insulating blanket permanently within the pouch.

2. A wrap as recited in claim 1 wherein the pouch assembly is generally rectangular.

3. An improved wrap as recited in claim 1 wherein the heat absorbing and heat insulating blanket comprises a first blanket of insulating material and a second blanket of heat absorbing material wherein the heat absorbing blanket is composed of a sandwich of material enclosing the heat absorbing material.

4. A wrap as recited in claim 1 wherein the fastening means comprises first and second fastening strips which together form a hook and pile fastener wherein one of the fastening strips is secured to one layer of the pouch assembly at one end; and the other fastening strip is secured to the opposed end of the other layer of the pouch assembly and over the entrance opening to the pouch assembly so as to simultaneously attach that strip and close the entrance opening to the pouch assembly.

5. A wrap as recited in claim 3 wherein the fastening strips are sewn to the pouch assembly.

6. An improved wrap as recited in claim 1 wherein the pouch assembly comprises generally rectangular inner and outer layers wherein the inner and outer layers are abutted and secured together so that they form the pouch and include a slit forming an entrance opening to the pouch.

7. An improved wrap as recited in claim 6 wherein all the layers are made of fabric.

8. An improved wrap as recited in claim 6 wherein the outer layer is approximately the same size as the inner layer, the inner layer is abutted to substantially overlay the outer layer wherein the outer layer is secured to the inner layer along its four peripheral edges, and wherein the entrance opening in the outer layer is provided by slitting the outer layer with the slit being of sufficient size to allow the integral heating and insulating blanket to pass therethrough but shorter than the width of the integral heating and insulating blanket.

9. An improved wrap as recited in claim 7 wherein the slit extends transversely across one end of the outer layer so that the entrance opening is adjacent to one end of the pouch.

10. An improved wrap as recited in claim 8 wherein the integral heat absorbing and insulating blanket includes an insulating blanket portion made of a compressable material slightly wider than the length of the slit, whereby the insulating blanket portion may be compressed when passing through the slit and will expand after being received in the outer pocket to prevent the integral heat absorbing and heat insulating blanket from passing back.

11. An improved wrap as recited in claim 9 wherein the entrance opening to the pouch is closed by attaching a portion of the fastening means to the outer layer covering the slit.

12. An improved wrap as recited in claim 10 wherein the fastening means comprises a hook and pile fastener.

13. An improved wrap as recited in claim 12 wherein the heat absorbing blanket portion is integrally stitched to the heat insulating blanket portion and the fastening means.

14. An improved wrap as recited in claim 1 wherein the integral heat absorbing and heat insulating blanket comprises:

(a) a flexible heat absorbing blanket portion including a compartment holding refreezable gel between first and second ends; and (b) a compressible insulating blanket portion wherein the heat absorbing blanket portion is glued at the first and second ends to the insulating blanket portion.

* * * * *